US010041704B2

(12) United States Patent
Lee et al.

(10) Patent No.: US 10,041,704 B2
(45) Date of Patent: Aug. 7, 2018

(54) OUTDOOR DEVICE FOR AN AIR CONDITIONER

(71) Applicant: LG ELECTRONICS INC., Seoul (KR)

(72) Inventors: Hoki Lee, Seoul (KR); Hyunjun Lim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 120 days.

(21) Appl. No.: 14/849,043

(22) Filed: Sep. 9, 2015

(65) Prior Publication Data

US 2016/0076796 A1 Mar. 17, 2016

(30) Foreign Application Priority Data

Sep. 12, 2014 (KR) ..... 10-2014-0120978

(51) Int. Cl.

| | |
|---|---|
| ***F25D 21/14*** | (2006.01) |
| ***F25B 13/00*** | (2006.01) |
| ***F24F 13/22*** | (2006.01) |
| ***F24F 1/46*** | (2011.01) |

(52) U.S. Cl.

CPC ..... *F25B 13/00* (2013.01); *F24F 1/46* (2013.01); *F24F 13/22* (2013.01)

(58) Field of Classification Search

CPC ..... F24F 1/36; F24F 1/56; F24F 1/22; F24F 1/10; F24F 1/16; F24F 5/00; F28F 2280/06; F28F 9/00; F28F 9/001

USPC ..... 62/498, 508

See application file for complete search history.

(56) References Cited

U.S. PATENT DOCUMENTS

| | | | |
|---|---|---|---|
| 4,309,365 | A | 1/1982 | Van Ness et al. |
| 7,971,448 | B2 | 7/2011 | Kim et al. |
| 2005/0150247 | A1 | 7/2005 | Ishihara et al. |
| 2005/0172656 | A1 | 8/2005 | Jung et al. |
| 2010/0116461 | A1 | 5/2010 | Saito et al. |
| 2010/0175407 | A1 | 7/2010 | Kim et al. |
| 2013/0205823 | A1 | 8/2013 | Yagyu |
| 2014/0131024 | A1 | 5/2014 | Iwazaki et al. |

(Continued)

FOREIGN PATENT DOCUMENTS

| | | |
|---|---|---|
| CN | 101586869 | 11/2009 |
| CN | 201348317 | 11/2009 |

(Continued)

OTHER PUBLICATIONS

United States Office Action dated Apr. 7, 2017 issued in co-pending U.S. Appl. No. 14/851,105.

(Continued)

*Primary Examiner* — Melvin Jones
(74) *Attorney, Agent, or Firm* — Ked & Associates LLP

(57) ABSTRACT

An outdoor device for an air conditioner is provided. The outdoor device may include a cabinet including at least one suction panel, a base provided at a lower portion of the cabinet, and a compressor and heat exchanger, which may be provided on the base. The base may include a base body, on which the compressor may be provided, an edge portion provided along a circumference of the base body, the edge portion including at least one seat that supports the heat exchanger, and a support guide provided on the edge portion to increase an area by which the heat exchanger may be supported.

27 Claims, 10 Drawing Sheets

(56) References Cited

U.S. PATENT DOCUMENTS

| | | | | |
|---|---|---|---|---|
| 2014/0298844 | A1* | 10/2014 | Luo | F24F 1/36 62/275 |
| 2014/0338384 | A1 | 11/2014 | Koike | |
| 2015/0000321 | A1* | 1/2015 | Kagawa | F25D 21/00 62/291 |
| 2016/0076779 | A1 | 3/2016 | Lee et al. | |

FOREIGN PATENT DOCUMENTS

| | | | |
|---|---|---|---|
| CN | 101726047 | | 6/2010 |
| CN | 102538086 | B | 6/2014 |
| CN | 103988026 | A | 8/2014 |
| CN | 203823946 | | 9/2014 |
| EP | 2 037 187 | | 3/2009 |
| EP | 2 180 267 | | 4/2010 |
| EP | 2184549 | A2 | 5/2010 |
| EP | 2 206 976 | | 7/2010 |
| EP | 2 738 476 | | 4/2014 |
| EP | 2 733 435 | A2 | 5/2014 |
| EP | 2 995 873 | | 3/2016 |
| JP | H 10-300131 | | 11/1998 |
| JP | H 11-264584 | | 9/1999 |
| JP | 2000-130800 | A | 5/2000 |
| JP | 2010-261712 | A | 11/2010 |
| JP | 2012-242026 | A | 12/2012 |
| JP | 2013-113513 | A | 6/2013 |
| KR | 10-2006-0083016 | | 7/2006 |
| KR | 10-2008-0056478 | | 6/2008 |
| KR | 10-2009-0040498 | A | 4/2009 |
| KR | 10-2009-0044504 | | 5/2009 |
| KR | 10-1401876 | A | 5/2014 |
| KR | 10-2014-0088625 | A | 7/2014 |
| KR | 10-2014-0093755 | A | 7/2014 |
| KR | 10-2014-0094648 | A | 7/2014 |
| WO | WO 2011/027709 | A1 | 3/2011 |
| WO | WO 2011/052318 | A1 | 5/2011 |
| WO | WO 2013/080760 | A1 | 6/2013 |
| WO | WO 2013/088713 | A1 | 6/2013 |

OTHER PUBLICATIONS

Korean Notice of Allowance dated Jun. 23, 2017.
U.S. Office Action issued in U.S. Appl. No, 14/851,105 dated Sep. 20 2017.
European Search Report dated Apr. 15, 2016 issued in Application No. 15195217.3.
Korean Office Action dated Mar. 18, 2016 issued in Application No. 10-2014-0120978.
Korean Office Action dated Mar. 18, 2016 issued in Application No. 10-2014-0120979.
Korean Office Action dated Apr. 1, 2016 issued in Application No. 10-2015-0048237.
Korean Office Action dated Apr. 1, 2016 issued in Application No. 10-2015-0066090.
European Search Report dated Apr. 5, 2016 issued in Application No. 15184052.7.
European Search Report dated Feb. 18, 2016 issued in Application No. 15184028.7.
European Search Report dated Jun. 23, 2016 issued in Application No. 15 19 5183.7.
Chinese Office Action dated Nov. 3, 2017 issued in Application No. 201510388473.8 (with English Translation).
Office Action dated Jan. 3, 2018 issued in co-pending U.S. Appl. No. 14/856,773.
Office Action dated Jan. 12, 2018 issued in co-pending U.S. Appl. No. 14/850,248.

* cited by examiner

OUTDOOR DEVICE FOR AN AIR CONDITIONER

CROSS-REFERENCE TO RELATED APPLICATION(S)

The present application claims priority under 35 U.S.C. 119 and 35 U.S.C. 365 to Korean Patent Application No. 10-2014-0120978, filed in Korea on Sep. 12, 2014, which is hereby incorporated by reference in its entirety.

BACKGROUND

1. Field

An outdoor device for an air conditioner is disclosed herein.

2. Background

Air conditioners are apparatuses for maintaining air in a predetermined space in a most suitable state according to their usage and purpose. In general, such an air conditioner may include a compressor, a condenser, an expansion device, and an evaporator. The air conditioner drives a refrigeration cycle for performing compression, condensation, expansion, and evaporation processes to cool or heat a predetermined space.

The predetermined space may be various places in which the air conditioner is used. For example, when the air conditioner is located in homes or offices, the predetermined space may be an inner space of a house or building. On the other hand, when the air conditioner is located in a vehicle, the predetermined space may be a passenger boarding space.

When the air conditioner performs a cooling operation, an outdoor heat exchanger provided in an outdoor unit or device may function as the condenser, and an indoor heat exchanger provided in an indoor unit or device may function as the evaporator. On the other hand, when the air conditioner performs a heating operation, the indoor heat exchanger may function as the condenser, and the outdoor heat exchanger may function as the evaporator.

The outdoor device of the air conditioner may include a base that defines a lower outer appearance of the outdoor device. The present Applicant applied for and registered Korean Registration No. KR 10-1401876 (hereinafter referred to as "related art document"), registered in Korea on May 30, 2014 and entitled "Base Assembly of Outdoor Unit for Air Conditioner", in which a base of an outdoor device is disclosed and which is hereby incorporated by reference. However, in the base of the outdoor device h7 for the air conditioner according to the related art document, defrosting water or rainwater may be stagnant in the base, and thus, may be frozen, causing a bad effect on an operation of the outdoor device.

BRIEF DESCRIPTION OF THE DRAWINGS

Embodiments will be described in detail with reference to the following drawings in which like reference numerals refer to like elements, and wherein.

DETAILED DESCRIPTION

Figure 1:
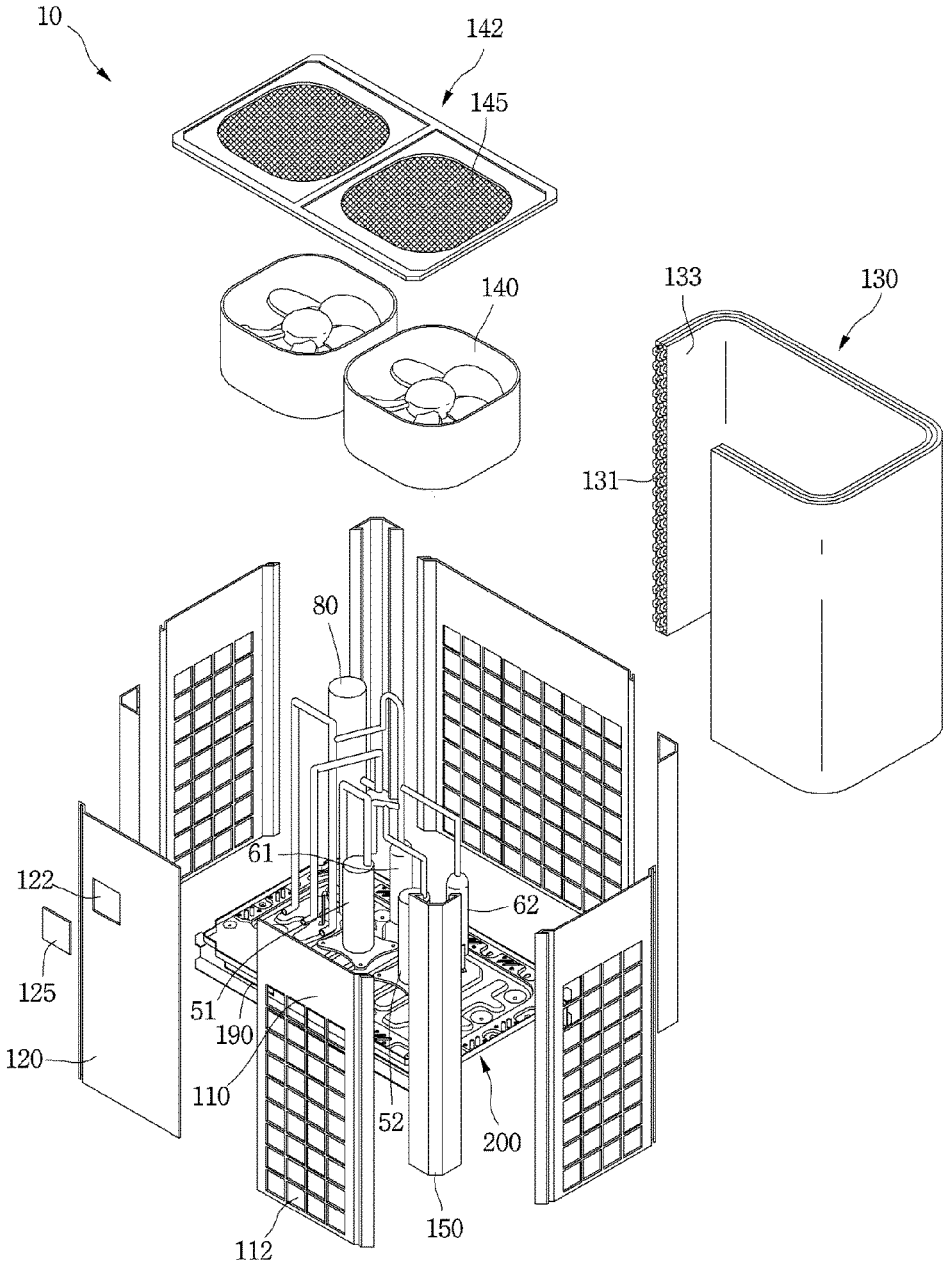
FIG. 1 is an exploded perspective view of an outdoor device of an air conditioner according to an embodiment.
Figure 2:
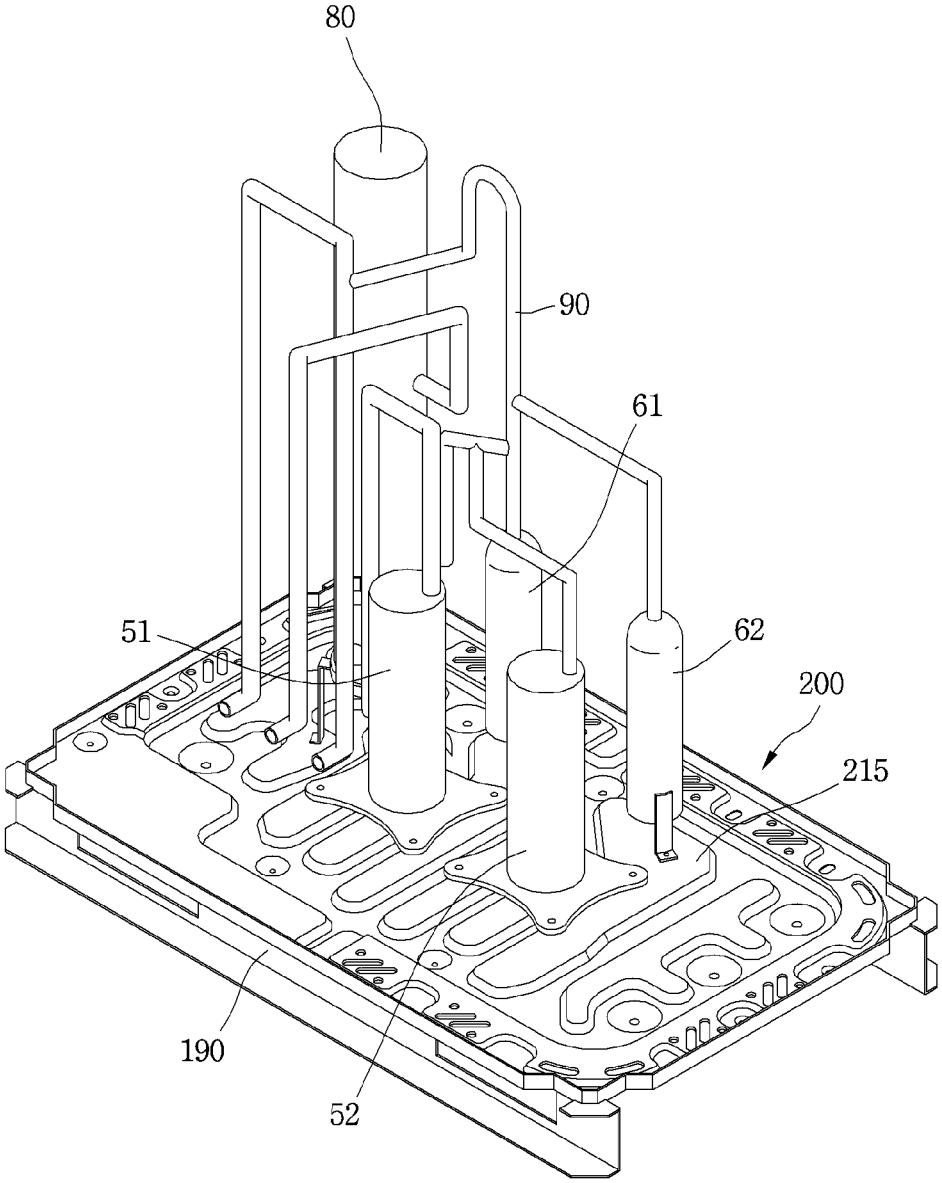
FIG. 2 is a perspective view illustrating a state in which a plurality of components is provided on a base of the outdoor device of FIG. 1.

FIG. 1 is an exploded perspective view illustrating an outdoor device of an air conditioner according to an embodiment. FIG. 2 is a perspective view illustrating a state in which a plurality of components is provided on a base of the outdoor device of FIG. 1.

Referring to FIGS. 1 and 2, an outdoor unit or device 10 for an air conditioner according to an embodiment may include a base 200 that defines a lower outer appearance of the outdoor device 10 and supports a plurality of components disposed in the outdoor device 10, at least one leg 190 provided on a lower portion of the base 200 so that the outdoor device 10 may be supported on or in an installation space, and a cabinet 110, 120, and 150 provided on the base 200. The at least one leg 190 may be provided on side lower portions of the base 200 and then placed on the installation space, such as the ground.

The cabinet 110, 120, and 150 may include a suction panel 110. A plurality of the suction panel 110 may be provided. The plurality of suction panels 110 may be provided along a circumference of the base 200. Each of the plurality of suction panels 110 may be provided to extend in an upward direction from an edge of the base 200.

For example, the plurality of suction panels 110 may be provided on first, second, third, and fourth sides of the base 200, for example, front and rear sides and both left and right sides of the base 200, in FIG. 1. The plurality of suction panels 110 may each include a suction grill 112 that introduces outdoor air into the outdoor device 10. The outdoor air may be introduced into the outdoor device 10 through the plurality of suction panels 110 from the front and rear sides or both left and right sides of the outdoor device 10.

The cabinet 110, 120, and 150 may further include a control panel 120. The control panel 120 may be a door openable to access a control box (not shown) provided inside of the outdoor device 10. For example, the control panel 120 may be rotatably or slidably provided.

The control panel 120 may be provided on or at a side of the suction panel 110, which is provided on or at a front side of the outdoor device 10, of the plurality of suction panels 110. Also, the control panel 120 may include a viewing window 122 through which a display of the control box may be viewable, and a cover member 125 that provides for selective opening of the viewing window 122.

The cabinet 110, 120, and 150 may further include a plurality of brackets 150 that supports the plurality of suction panels 110 and the control panel 120. The plurality of bracket 150 may extend in the upward direction from the base 200.

For example, a first bracket of the plurality of brackets 150 may be provided between adjacent suction panels 110 of the plurality of suction panels 110 to support the adjacent suction panels 110. That is, the adjacent suction panels 110 may be coupled to both sides of the first bracket.

A second bracket of the plurality of brackets 150 may be provided between one of the plurality of suction panels 120 and the control panel 120 provided adjacent to the one of the plurality of suction panels 110 to support the one suction panel 110 and the control panel 120. That is, the one suction panel 110 and the control panel 120 may be coupled to both sides of the second bracket.

A heat exchanger 130 may be provided inside of the outdoor device 10. The heat exchanger 130 may extend along inner side surfaces of the cabinet 110,120, and 150. In other words, the heat exchanger 130 may be bent several times to extend along the inner side surfaces of the plurality of suction panels 110.

The heat exchanger 130 may include a heat exchange tube 131 through which a refrigerant may flow and a plurality of heat exchange fins 133 coupled to the heat exchange tube 131 to assist heat-exchange of the refrigerant. The heat exchange tube 131 may form at least a portion of a refrigerant tube 90, and the plurality of heat exchange fins 133 may each provide a surface to exchange heat between the refrigerant and air.

The heat exchange tube 131 may be inserted into the plurality of heat exchange fins 133, and the plurality of heat exchange fins 133 may be provided to be spaced apart from each other. The plurality of heat exchange fins 133 may be provided along a direction in which a circumference or edge portion 220 of the base 200 extends. Outdoor air introduced through the plurality of suction grills 112 of the plurality of suction panels 100 may be heat-exchanged while passing through the heat exchanger 130.

The outdoor device 10 may further include at least one blower fan 140 to introduce or drawn in the outdoor air, and a discharge panel 142 provided on or at a side of the at least one blower fan 140. The discharge panel 142 may include at least one discharge grill 145 to exhaust air outside of the outdoor device 10.

The at least one blower fan 140 may be provided in an upper portion of the outdoor device 10, and the discharge panel 142 may be provided on an upper portion of the at least one blower fan 140. Air passing through the heat exchanger 130 may flow upward to be exhausted outside of the outdoor device 10 via the at least one blower fan 140 and the discharge panel 142.

A plurality of components may be provided on the base 200. The base 200 may include seats (see reference numerals 215 and 225 of FIG. 4) that support the plurality of components.

The plurality of components may include compressors 51 and 52 that compress a refrigerant, oil separators 61 and 62 provided on or at an outlet-side of each of the compressors 51 and 52 to separate oil contained in the refrigerant, a gas-liquid separator 80 provided on or at an inlet-side of the compressors 51 and 52 to separate a liquid refrigerant and supply a gaseous refrigerant to the compressor 51 and 52, and the refrigerant tube 90 connected to the compressors 51 and 52, the oil separators 61 and 62, and the gas-liquid separator 80 to guide a flow of the refrigerant. The compressors 51 and 52 may include a first compressor 51 and a second compressor 52. The oil separators 61 and 62 may include a first oil separator 61 provided on or at the outlet-side of the first compressor 51, and a second oil separator 62 provided on or at the outlet-side of the second compressor 52.

Hereinafter, the base will be described in detail with reference to the accompanying drawings.

Figure 3:
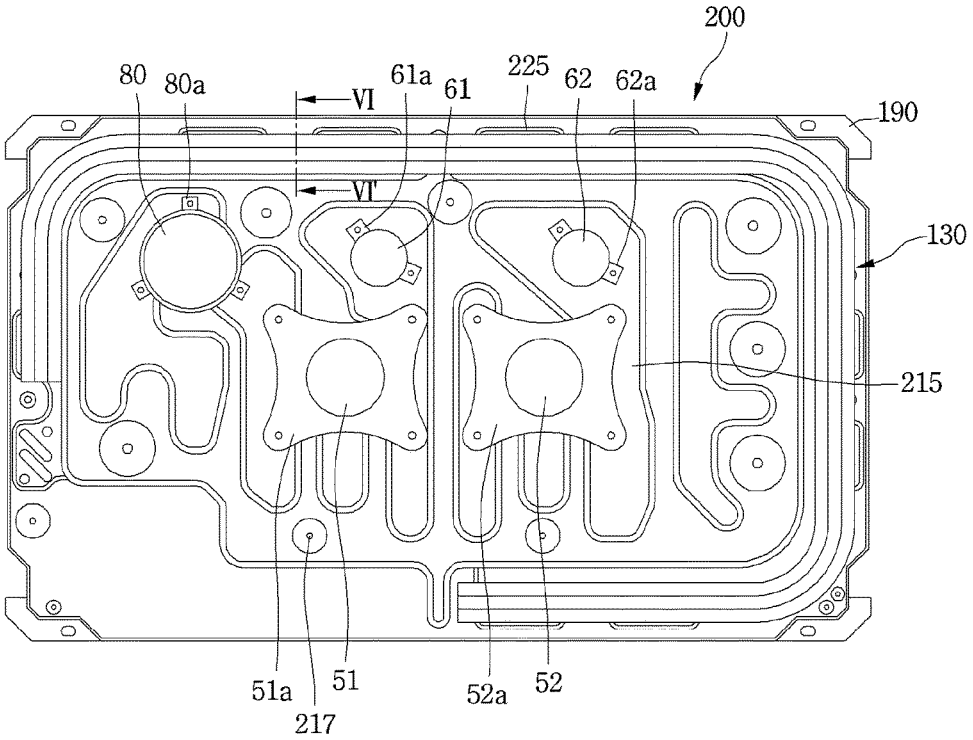
FIG. 3 is a plan view illustrating the state in which the plurality of components is provided on the base of the outdoor device of FIG. 1.
Figure 4:
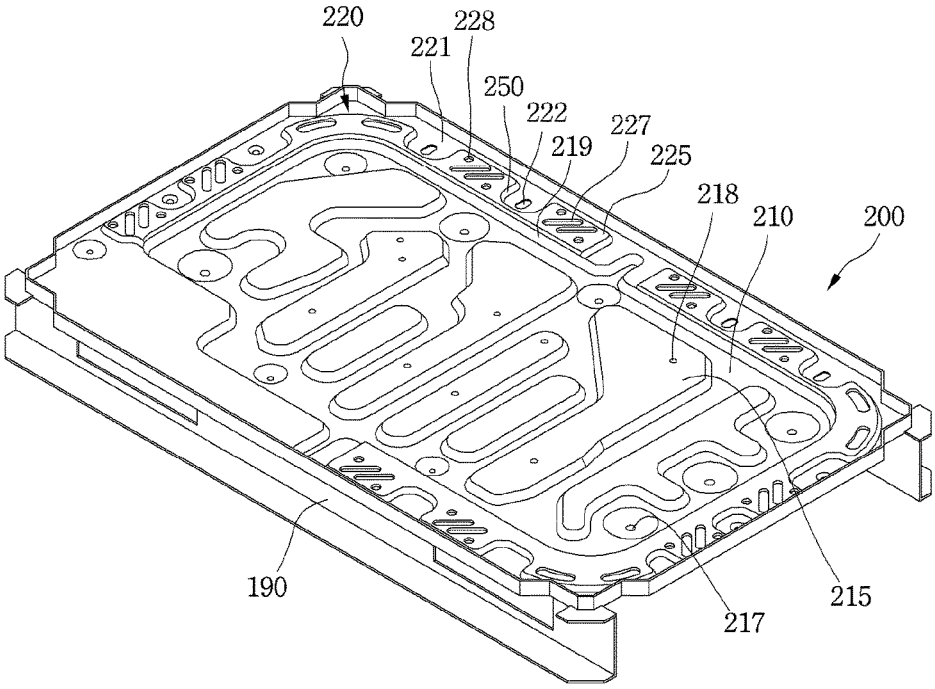
FIG. 4 is a perspective view of the base of the outdoor device of FIG. 1.
Figure 5:
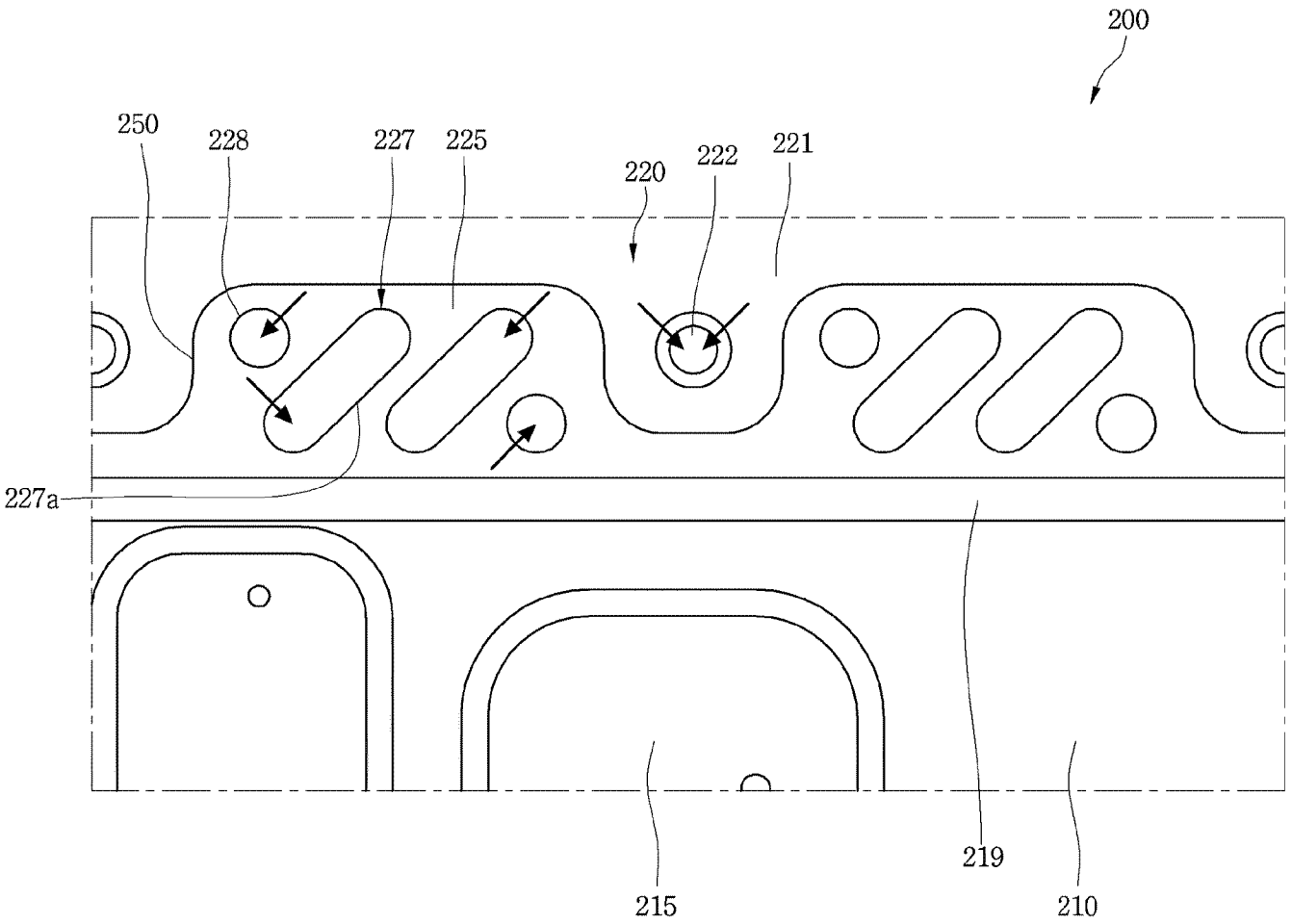
FIG. 5 is a partial plan view illustrating a main component of the base of the outdoor device of FIG. 1.

FIG. 3 is a plan view illustrating the state in which the plurality of components is provided on the base of the outdoor device of FIG. 1. FIG. 4 is a perspective view of the base of the outdoor device of FIG. 1. FIG. 5 is a partial plan view illustrating a main component of the base of the outdoor device of FIG. 1.

Referring to FIGS. 3 to 5, the base 200 of the outdoor device 10 according to an embodiment may include a base body 210 that defines a lower outer appearance thereof, and the circumference or edge portion 220 provided on or at an outside of the base body 210. The base 200 may further include the seats 215 and 225, on which at least portions of the plurality of components may be seated.

The seats 215 and 225 may include a first seat 215 provided on the base body 210 and on which at least first components of the plurality of components may be seated, and a second seat 225 provided on the circumference or edge portion 220 and on which at least second components of the plurality of components may be seated.

The first seat 215 may support, for example, the compressors 51 and 52, the oil separators 61 and 62, and the gas-liquid separator 80. For example, the compressors 51 and 52, the oil separators 61 and 62, and the gas-liquid separator 80 may be coupled to the first seat 215.

A plurality of coupling holes 218, to which the compressors 51 and 52, the oil separators 61 and 62, and the gas-liquid separator 80 may be coupled, may be defined in the first seat 215. Each of the compressors 51 and 52, the oil separators 61 and 62, and the gas-liquid separator 80 may include a plurality of supports each fixed to the plurality of coupling holes 218 by, for example, a plurality of coupling members.

For example, the plurality of supports may include first and second compressor supports 51*a* and 52*a*, respectively, on which the first and second compressors 51 and 52 may be provided, first and second oil separator supports 61*a* and 62*a*, respectively, on which the first and second oil separators 61 and 62 may be provided, and a gas-liquid separator support 80*a*, on which the gas-liquid separator 80 may be provided.

Liquid existing in or contained within the outdoor device 10, that is, defrost water or water introduced from the outside, such as rainwater, may be contained in the base body 210. The liquid may be discharged to a lower side of the base 200 through at least one first drain hole 217 defined in the base body 210. Accordingly, the base body 210 or the base 200 may be referred to as "a drain pan".

The first seat 215 may protrude in the upward direction from the base body 210. As the compressors 51 and 52, the oil separators 61 and 62, and the gas-liquid separator 80 may be supported by the first seat 215, lower portions of the compressors 51 and 52, the oil separators 61 and 62, and the gas-liquid separator 80 may be spaced in the upward direction from the base body 210. Due to the first seat 215, the compressors 51 and 52, the oil separators 61 and 62, the gas-liquid separator 80 may not be affected by the liquid existing in or contained within the base body 210.

The circumference or edge portion 220 may extend along a circumference of the base body 210 and may be stepped in the upward direction from the base body 210. That is, the circumference or edge portion 220 may have an upper surface positioned higher than an upper surface of the base body 210.

A step (see reference numeral 219 of FIG. 4) that provides a height difference between the base body 210 and the circumference or edge portion 220 may be provided between the base body 210 and the circumference or edge portion 220. The circumference or edge portion 220 may be positioned higher than the base body 210 by the step 219.

The circumference or edge portion 220 may extend by a predetermined distance from the step 219 toward an outside of the base body 210, or in an outward direction. Further, the circumference or edge portion 220 may include an edge body 221 provided on the base body 210, and a second seat 225 that protrudes in the upward direction from the edge body 221 to seat the heat exchanger 130 thereon.

The liquid existing in or contained within the outdoor device 10, for example, the defrost water or water introduced from the outside, such as rainwater, may be contained in the edge body 221. As the second seat 225 may be spaced in the upward direction from the edge body 221, a lower portion of the heat exchanger 130 may be spaced in the upward direction from the edge body 221, and thus, the heat exchanger 130 may not be affected by the liquid existing in or contained within the edge body 221.

The base 200 may include a plurality of drain holes 217, 222, 227, and 228. The plurality of drain holes 217, 222, 227, and 228 may include a first drain hole 217 defined in the base body 210, a second drain hole 222 defined in the edge body 221, and third and fourth drain holes 227 and 228 defined in the second seat 225. The first to fourth drain holes 217, 222, 227, and 228 may be defined in the base body 210, the edge body 221, and the second seat 225 to vertically pass therethrough. A plurality of each of the first to fourth drain holes 217, 222, 227, and 228 may be provided, and the plurality of the drain holes may be spaced apart from each other.

Due to height differences between the base body 210, the edge body 221, and the second seat 225, the third drain hole(s) 227 and the fourth drain hole(s) 228 may be defined at a same height, the third drain hole(s) 227 may be defined higher than the second drain hole(s) 222, and the second drain hole(s) 222 may be defined higher than the first drain hole(s) 217.

The third drain hole(s) 227 may have a size greater than a size of the fourth drain hole(s) 228. For example, the third drain hole(s) 227 may extend at an incline with respect to the plurality of heat exchange fins 133 from an approximately central portion of the second seat 225, and the fourth drain hole(s) 228 may be defined in or at each of both sides of the third drain hole(s) 227.

A plurality of the third drain hole 227 may be provided adjacent to one another, and the plurality of third drain holes 227 may be spaced apart from each other. The fourth drain hole 228 may be defined in or at each of first and second sides of the plurality of adjacent third drain holes 227.

Each third drain hole 227 may include a hole inclination portion 227*a* that extends at a linear incline with respect to a direction in which the plurality of heat exchanger fins 133 extends. The hole inclination portion 227*a* may be a portion of the second seat 225 that defines the third drain hole 227. That is, the third drain hole 227 may extend in a direction that crosses the direction in which the plurality of heat exchange fins 133 extends.

The base 200, that is, the base body 210 and the circumference or edge portion 220 may function as a drain pan to drain the defrost water and other water. The plurality of drain holes may be defined in the base 200 to improve the drain function.

However, if a large number of drain holes is defined, that is, if a large number of drain holes is defined in the circumference or edge portion 220, an area that supports the heat exchanger 130, that is, an area of the second seat 225 that supports the heat exchange fin 133 may be reduced. Thus, stable support of the heat exchanger 130 may be limited, and the second seat 225 may be reduced in rigidity.

Thus, in this embodiment, the third drain hole(s) 227 may be defined at an incline with respect to the extending direction of the plurality of heat exchange fins 133, so as to maintain the area that supports the heat exchanger 130 greater than a preset or predetermined area, which may easily drain water. When the third drain hole 227 extends at an incline, an outer circumference of the third drain hole 227 may be increased in length, and thus, a portion or area that supports the plurality of heat exchange fins 133 of an entire portion or area of the second seat 225 may increase. The fourth drain hole(s) 228 may be defined in or at least a side of the third drain hole(s) 227 to further improve the drain function.

The base 200 may further includes a blocking portion 250 that defines a step between the edge body 221 and the second seat 225 to prevent liquid from flowing from the edge body 221 to the base body 210. The blocking portion 250 may define the step between the edge body 221 and the second seat 225. The blocking portion 250 may extend in the upward direction from the edge body 221 toward the second seat 225. The blocking portion 250 may have a height sufficient to prevent liquid existing in or contained within the edge body 221 from being introduced into the base body 210.

The step 219 may form a step between the base body 210 and the circumference or edge portion 220, in particular, a step between the base body 210 and the second seat 225. Also, the blocking portion 250 may form a step between the edge body 221 and the second seat 225. The step 219 may be referred to as a "first step", and the blocking portion 250 may be referred to as a "second step".

A lower portion of the heat exchanger 130 may be provided on the second seat 225 at a position spaced in the upward direction from the second drain hole(s) 222. The block portion 250 may be provided adjacent to the second drain hole(s) 222 at an outside of the second drain hole(s) 222. For example, the blocking portion 250 may be spaced a preset or predetermined distance from the second drain hole(s) 222 to surround at least a portion of each of the second drain hole(s) 222.

For example, defrosting water generated by the heat exchanger 130 or water introduced into the outdoor device 10, such as rainwater, may exist in or be contained within the edge body 221. The liquid may be drained in the downward direction through the second drain hole(s) 222. Due to the blocking portion 250, the liquid existing in or contained within the edge body 221 may not be introduced into the base body 210, but rather, may be guided to the second drain hole(s) 222.

The base body 210 may have a preset or predetermined capability or capacity for drainage processing. When the liquid in the edge body 221 is introduced into the base body 210, an amount of liquid, which may be over the preset or predetermined capability or capacity of the base body 210 may exist in or be contained within the base body 210, and thus, the liquid may not be smoothly drained. When the liquid which is not continuously drained exists in or is contained within the base body 210, the liquid may be frozen according to an outdoor environment. According to this embodiment, the blocking portion 250 may be provided to smoothly drain the liquid existing in or contained within the edge body 221 through the second to fourth drain holes 222, 227, and 228, thereby solving the above-described limitations.

Figure 6:
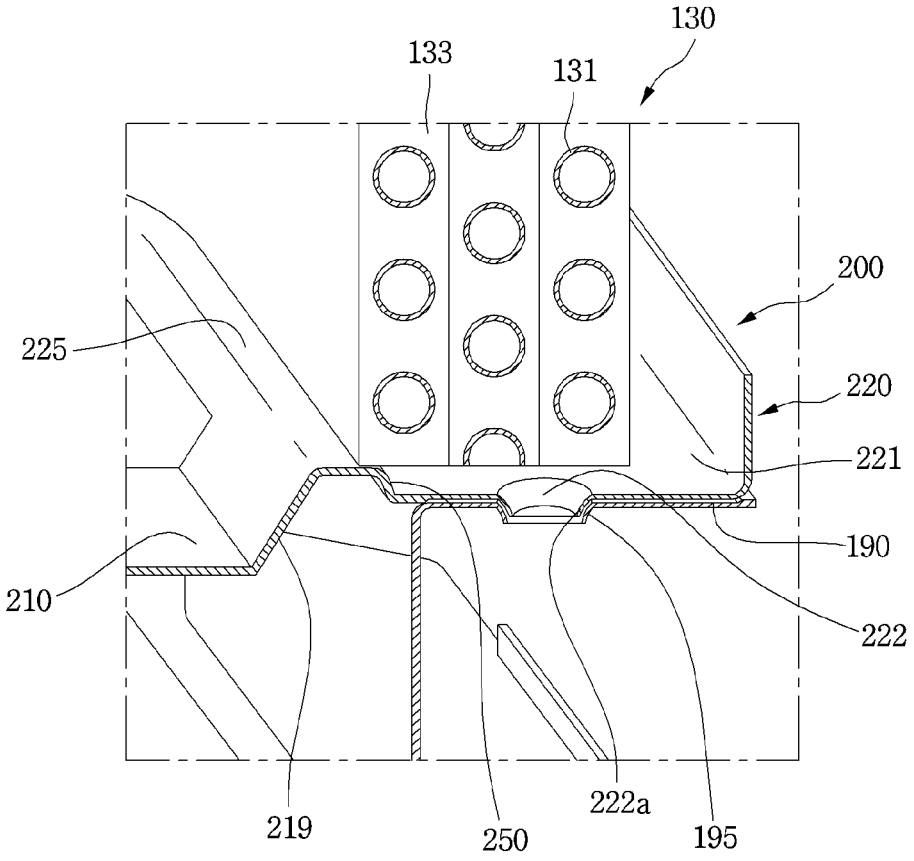
FIG. 6 is a cross-sectional view, taken along line VI-VI' in FIG. 3.
Figure 7:
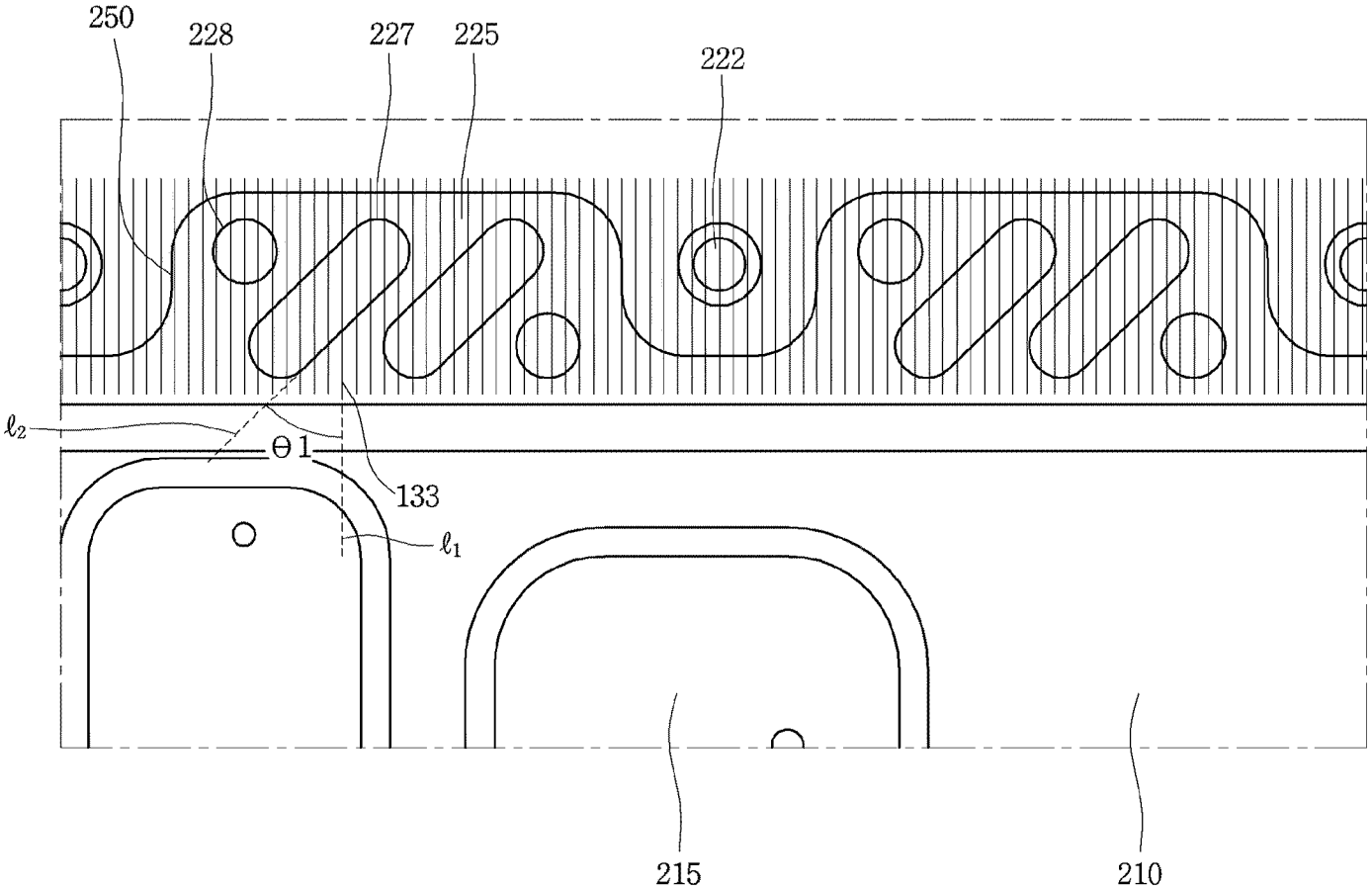
FIG. 7 is a partial plan view illustrating a state in which a plurality of heat exchange fins is located on the base of the outdoor device of FIG. 1.

FIG. 6 is a cross-sectional view, taken along line VI-VI' in FIG. 3. FIG. 7 is a partial plan view illustrating a state in which a plurality of heat exchange fins is located on the base of the outdoor device of FIG. 1.

The heat exchanger 130 according to this embodiment may be seated on the second seat 225 of the circumference or edge portion 220. The heat exchanger 130 may be bent several times to extend along the circumference or edge portion 220. Thus, the heat exchanger 130 may be provided to face the plurality of suction grills 112 of the plurality of suction panels 110.

The plurality of heat exchange fins 133 provided in the heat exchanger 130 may be supported by a top surface of the second seat 225. The heat exchange tube 131 may be bent to correspond to a bent configuration of the heat exchanger 130, and the plurality of heat exchange fins 133 may be spaced apart from each other and coupled to the heat exchange tube 131.

An angle between a virtual line l1 that extends in a direction in which the plurality of heat exchange fins 133 extends on the second seat 225, and a virtual line l2 that extends from the hole inclination portion 227*a* may be defined as a set angle $\theta_1$. The set angle $\theta_1$ may be greater than 0°.

A downward guide 222*a* that extends at an inclined or roundly in the downward direction so that liquid easily flows in the downward direction may be provided in each of the first to fourth drain holes 217, 222, 227, and 228.

The plurality of the legs 190 may be coupled to a lower portion of the circumference or edge portion 220. Each leg 190 may include a leg drain hole 195 that guides the liquid drained from the circumference or edge portion 220 in the downward direction. The leg drain hole 195 may be defined in or at a position corresponding to the second drain hole 222.

Figure 8:
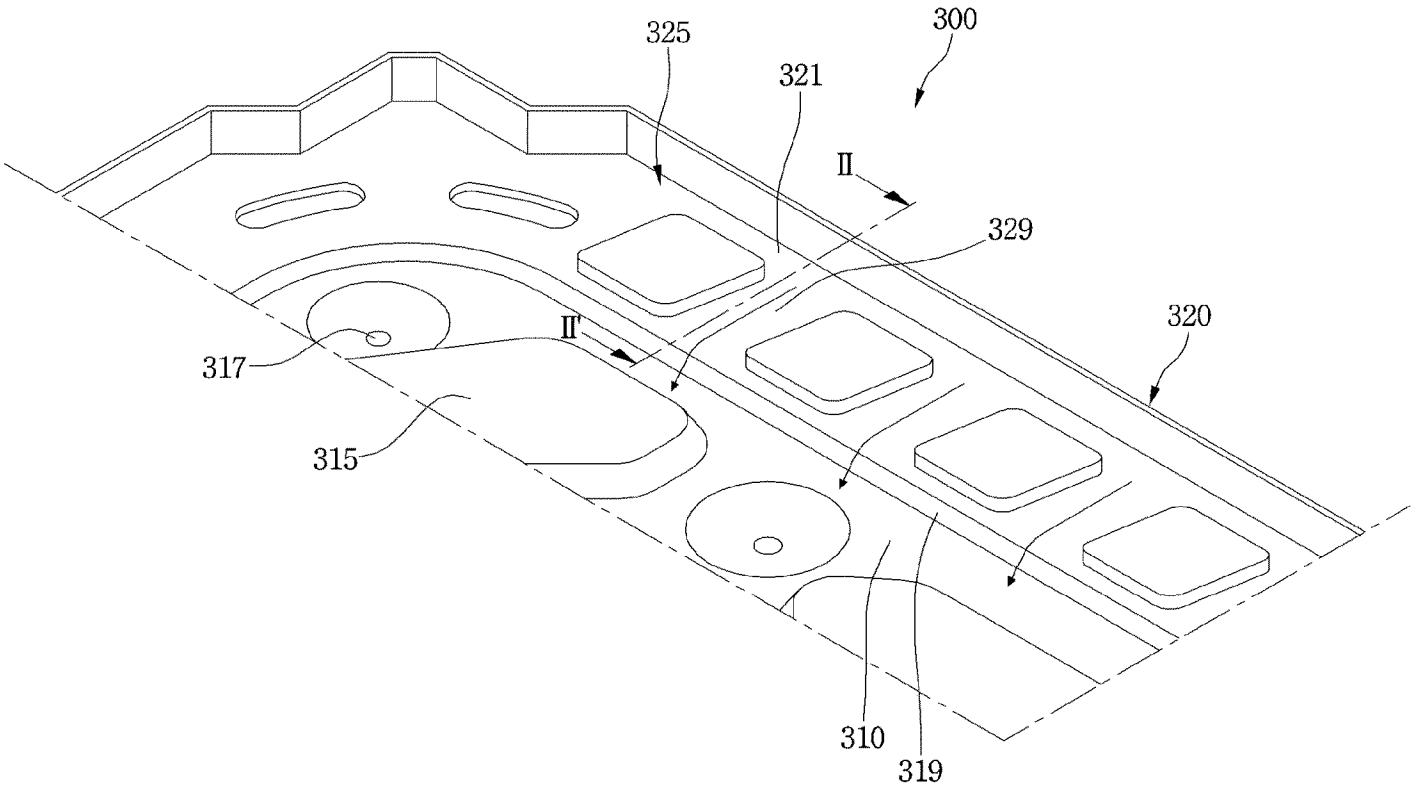
FIG. 8 is a partial perspective view illustrating a base of an outdoor device according to another embodiment.
Figure 9:
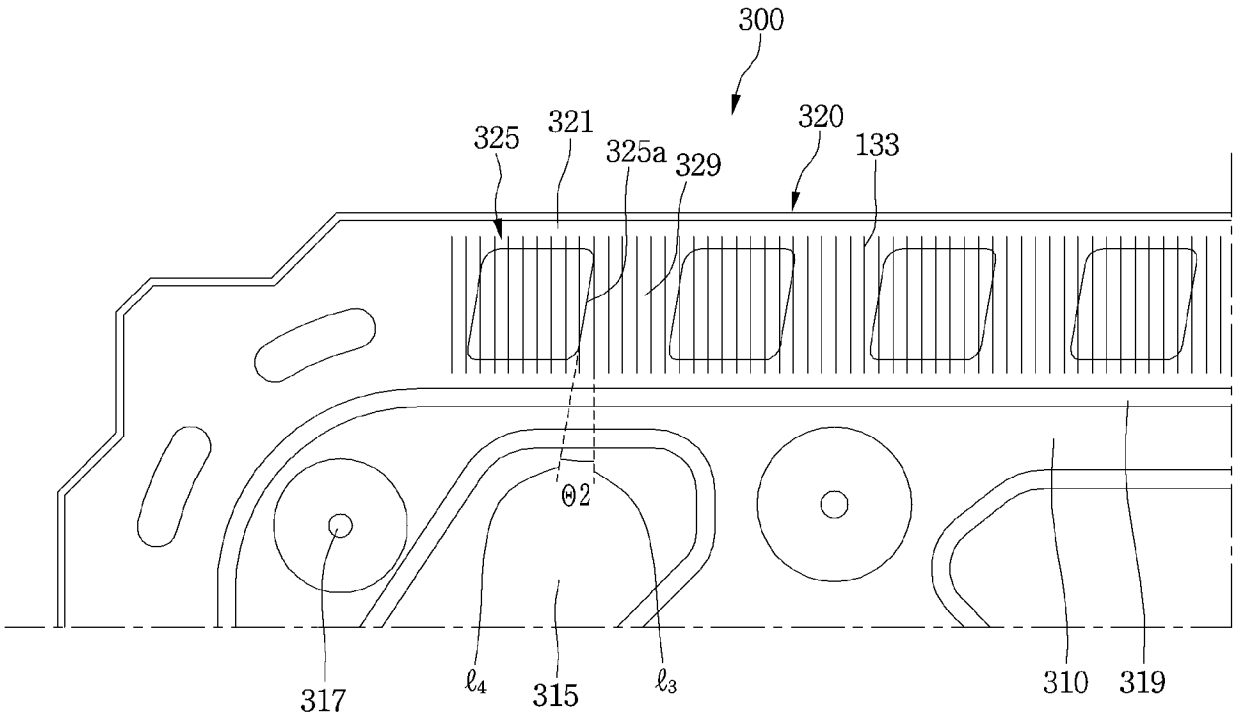
FIG. 9 is a partial plan an view illustrating a state in which a plurality of heat exchange fins is located on the base of the outdoor device of FIG. 8.
Figure 10:
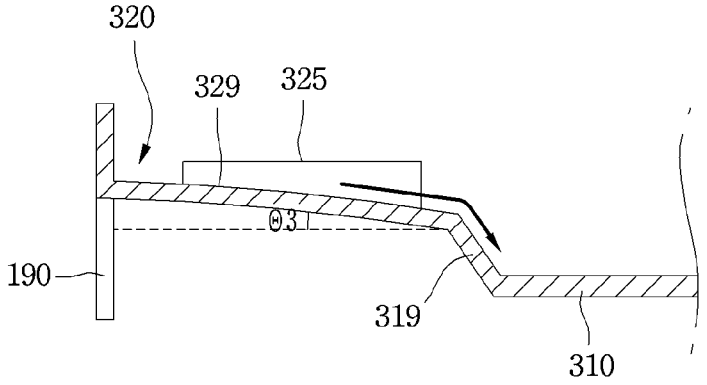
FIG. 10 is a cross-sectional view, taken along line X-X' in FIG. 8.

FIG. 8 is a partial perspective view illustrating a base of an outdoor device according to another embodiment. FIG. 9 is a partial plan view illustrating a state in which a plurality of heat exchange fins is located on the base of the outdoor device of FIG. 8. FIG. 10 is a cross-sectional view, taken along line X-X' in FIG. 8.

Referring to FIGS. 8 to 10, a base 300 according to this embodiment may include a base body 310 that defines a lower outer appearance thereof, and a circumference or edge portion 320 provided at an outside of the base body 310 to surround the base body 310, and a step 319 that defines a step between the base body 310 and the circumference or edge portion 320. The step 319 may extend in an upward direction from a circumference of the base body 310, and the circumference or edge portion 320 may extends in an outward direction from the step 319. Due to this configuration, the circumference or edge portion 320 may be provided higher than the base body 310.

The base 300 may include a plurality of seats 315 and 325, on which a plurality of components provided in outdoor device 10 may be seated. The plurality of seats 315 and 325 may include a first seat 315 that protrudes in the upward direction from the base body 310, and a second seat 325 that protrudes in the upward direction from the circumference or edge portion 320. A plurality of each of the first and second seats 315 and 325 may be provided.

The plurality of first seats 315 may support compressors 51 and 52, oil separators 61 and 62, gas-liquid separator 80. The second seat 325 may support heat exchanger 130.

A plurality of drain holes 317, through which liquid existing in or contained within the base body 310 may be drained in the downward direction, may be defined in the base body 310.

The circumference or edge portion 320 may include an edge body 321 provided higher than the base body 310, and the second seat 325 that protrudes in the upward direction from the edge body 321 to seat the heat exchanger 130 thereon. A plurality of the second seat 325 may be provided. The plurality of second seats 325 may be spaced apart from each other. The edge body 312 may include a guide 329 provided between the plurality of second seats 325 to guide liquid, such as defrosting water, so that the liquid may flow into the base body 310.

Each second seat 325 may extend at an incline in a direction in which the heat exchanger 130 extends. Each second seat 325 may include an inclination portion 325*a* that extends at an incline with respect to a direction in which the plurality of heat exchanger fins 133 of the heat exchanger 130 extends. The inclination portion 325*a* may define at least a portion of a circumference or outer surface of the second seat 325.

An angle between a virtual line l3 that extends in the direction in which the plurality of heat exchange fins 133 extends on the second seat 225, and a virtual line l4 that extends from the inclination portion 352*a* may be defined as a set angle $\theta_2$. The set angle $\theta_2$ may be greater than 0°. As the second seat 325 includes the inclination portion 325*a*, a portion or area that supports the plurality of heat exchange fins 133 of an entire portion or area of the second seat 325 may increase.

The guide 329 may extend at an incline in a downward direction toward a horizontal surface or the base body 310. An angle between the guide 329 and the horizontal surface or the base body 310 may be defined as a set angle $\theta_3$. That is, the guide 329 may be an inclined surface defined on the edge body 321.

The guide 329 may be provided between the plurality of second seats 325 that protrudes in the upward direction from the circumference or edge portion 320. The second seat 325 may be a portion on which the heat exchanger 130 may be seated. The second seat 325 may include an upper surface that extends parallel to a horizontal surface.

As the circumference or edge portion 320 may include the guide 329 which is inclined downward toward the base body 310, liquid existing in or contained within the circumference edge portion 320, that is, defrosting water generated by the heat exchanger 130, may be introduced into the base body 310. The liquid introduced into the base body 310 may be guided to the plurality of drain holes 317 of the base body 310 and be easily drained to a lower side of the base 300. That is, the guide 329 may be provided inclined toward the drain hole 317 of the base body 310 to guide drainage of the liquid.

For convenience of description, the set angle $\theta_1$ may be referred to as a "first set angle", the set angle $\theta_2$ may be referred to as a "second set angle", and the set angle $\theta_3$ may be referred to as a "third set angle".

Also, a third drain hole 227 including the inclination portion 227*a* described in the previous embodiment and the second seat 325 including the inclination portion 325*a* described in the previous embodiment may increase in portion or area thereof by which the heat exchanger 130 is supported to stably support the heat exchanger 130. Thus, the inclination portions 227*a* and 325*a* may each be referred to as a "support guide device".

According to embodiments disclosed herein, as the guide may be provided on the base, liquid existing in or contained within the outdoor device may be easily drained to the drain hole(s). Further, the seat, on which the heat exchanger may be seated, may be provided below the heat exchanger provided in the outdoor device, and the drain hole which is inclined in the direction in which the plurality of heat exchange fins is arranged may be defined in the seat. Thus, the drain hole may increase in size, and also, the area that supports the heat exchanger may be sufficiently secured. Therefore, the heat exchanger may be stably supported.

Furthermore, as the seat may include an inclination portion that extends at an incline in the direction in which the plurality of heat exchange fins is arranged, the area that supports the or contained within heat exchange fins may be sufficiently secured. Also, as the inclination surface is provided between the seats, liquid existing in or contained within the circumference or edge portion of the base may flow to the base body and be easily drained to the drain hole. Additionally, as the guide may include the blocking portion provided on the circumference or edge portion of the base, liquid may be prevented from being introduced to the base body by the blocking portion, and thus, may be guided to the drain hole(s) defined in the circumference or edge portion.

Embodiments disclosed herein provide an outdoor unit or device for an air conditioner, in which liquid within the outdoor unit is capable of being smoothly discharged.

Embodiments disclosed herein provide an outdoor unit or device for an air conditioner that may include a cabinet including at least one suction panel; a base disposed in or at a lower portion of the cabinet; and a compressor and heat exchanger, which are disposed on the base. The base may include a base body on which the compressor may be disposed; a circumference or edge part or portion disposed along a circumference of the base body, the edge part including a seat part or seat that supports the heat exchanger; and a support guide device or guide disposed on the edge part to increase an area by which the heat exchanger is supported. The support guide device may include a drain hole defined in the seat part to extend inclined in a direction in which the heat exchanger is placed.

The heat exchanger may include a heat exchange tube, and a heat exchange fin, and the seat part may include a hole inclination part or portion that defines the drain hole and supports a lower portion of the heat exchange fin. An angle between a virtual line (l1) that extends in a direction in which the heat exchange fin is placed or extends on the seat part, and a virtual line (l2) that extends from the hole inclination part may be defined as a first set angle.

The edge part may include an edge body disposed at a position higher than a position of the base body; and a blocking part or portion that extends upward from the edge body toward the seat part to prevent water from being introduced from the edge part to the base body. The outdoor unit may further include a stepped part or step that extends upward from the base body toward the edge part.

The support guide device may include an inclination part or portion that defines at least a portion of a circumference of the seat part and that extends inclined in a direction in which the heat exchanger is placed.

The heat exchanger may include a heat exchange tube, and a heat exchange fin, and an angle between a virtual line (l3) that extends in a direction in which the heat exchange fin is placed or extends on the seat part, and a virtual line (l4) that extends from the inclination part may be defined as a second set angle.

The seat part may be provided in plurality, and a guide part or guide that extends inclined downward toward the base body may be disposed between the plurality of seat parts. The base body may include a drain hole that drains water, which is introduced from the edge part toward the base body, through the guide part.

Embodiments disclosed herein further provide an outdoor unit or device for an air conditioner that may include a cabinet including at least one suction panel; and a base disposed in or at a lower portion of the cabinet. The base may include a base body including a first seat part or seat by which a compressor may be supported, and a first drain hole that drains water; and a circumference or edge part or portion disposed along a circumference of the base body to support a heat exchanger including a heat exchange tube and a heat exchange fin. The edge part may include an edge body disposed on the base body; a second seat part or seat that protrudes upward from the edge body; and a support guide device or guide defined in the second seat part and that increases an area by which the heat exchanger fin is supported.

The support guide device may include a third drain hole defined in the second seat part. The third drain hole may be inclined at a first set angle in a direction in which the heat exchange fin is placed or extends.

The outdoor unit may further include a second drain hole defined in the edge body. The outdoor unit may further include a fourth drain hole defined in the second seat part in at least a side of the third drain hole.

The support guide device may include an inclination or inclination part that is disposed on an outer surface of the second seat part, and inclined at a second set angle in a direction in which the heat exchange fin is placed or extends. The second seat part may include a guide part or guide that is provided in plurality and extends inclined downward toward the first drain hole disposed between the plurality of second seat parts.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An outdoor device for an air conditioner, the outdoor device comprising:

a cabinet including at least one suction panel;

a base provided at a lower side of the cabinet; and a compressor and a heat exchanger, each of which, are provided on the base, wherein the base includes:

a base body on which the compressor is provided;

an edge portion provided along a circumference of the base body, the edge portion including at least one seat that supports an heat exchanger; and a support guide provided on the edge portion to increase an area by which the heat exchanger is supported, wherein the support guide comprises on inclination portion that defines at least a portion of a circumference of the at least one seat and extends at an angle with respect to a direction in which the heat exchanger extends.

2. The outdoor device according to claim 1, wherein the support guide comprises at least one drain hole defined in the at least one seat that extends at an angle with respect to a direction in which the heat exchanger extends.

3. The outdoor device according to claim 2, wherein the heat exchanger comprises a heat exchange tube, and a plurality of heat exchange fins, and wherein the at least one seat comprises a hole inclination portion that defines the at least one drain hole and supports a lower portion of the plurality of heat exchange fins.

4. The outdoor device according to claim 3, wherein an angle between a virtual line (l1) that extend in a direction in which the plurality of heat exchange fins extends on the at least one seat and a virtual line (l2) that extends from the hole inclination portion is a predetermined angle.

5. The outdoor device according to claim 1, wherein the edge portion includes:

an edge body provided at a position higher than a position of the base body; and a blocking portion that extends in an upward direction from the edge body toward the at least one seat to prevent liquid from being introduced from the edge portion to the base body.

6. The outdoor device according to claim 1, farther comprising a step that extends in an upward direction from the base body toward the edge portion.

7. The outdoor device according to claim 1, wherein the heat exchanger comprises a heat exchange tube, and a plurality of heat exchange fins, and wherein, an angle between a virtual line (l3) that extends in a direction in which the plurality of heat exchange fins extends on the at least one seat and a virtual line (l4) that extends from the inclination portion is a predetermined angle.

8. The outdoor device according to claim 1, wherein the at least one seat comprises a plurality of seats, and wherein a guide that extends at an incline in a downward direction toward the base body is provided between the plurality of seats.

9. The outdoor device according to claim 8, wherein the base, body includes at least one drain hole to drain liquid, which is introduced from the edge portion toward the base body, through the guide.

10. An air conditioner including the outdoor device of claim 1.

11. An outdoor device for an air conditioner, the outdoor device comprising:

a cabinet including at least one suction panel; and a base provided at a lower side of the cabinet, wherein the base includes;

a base body including at least one first seat by which a compressor is supported and at least one first drain hole to drain liquid; and an edge portion provided along a circumference of the base body to support a heat exchanger including a heat exchange tube and a plurality of heat exchange fins, wherein the edge portion includes:

an edge body provided at an upper side of the base body;

at least one second seat that protrudes in an upward direction from the edge body; and at least one second drain hole defined in the second seat, wherein the at least one second drain hole is inclined at a predetermined angle with respect to a direction in which the plurality of heat exchange fins extends.

12. The outdoor device according to claim 11, farther comprising at least one third drain hole defined in the edge body.

13. The outdoor device according, to claim 11, further including at least one third drain hole defined in the at least one second seat and located at a side of the at least one second drain hole.

14. The outdoor device according to claim 11, wherein the edge portion further includes a blocking portion that defines a step between the edge body and the at least one second seat to prevent liquid from flowing from the edge body to the base body.

15. An air conditioner including the outdoor device according to claim 11.

16. An outdoor device for an air conditioner, the outdoor device comprising:

a cabinet; and a base provided at a lower side of the cabinet, wherein the base includes:

a base body on which at least one first seat that supports a compressor is provided; and an edge portion provided along a circumference of the base body to support a heat exchanger including a heat exchange tube and a plurality of heat exchange fins, wherein the edge portion includes:

an edge body provided at an upper side of the base body; and at least one second seat that protrudes in an upward direction from the edge body, wherein the at least one second seat includes an inclination portion which is inclined at a predetermined angle with respect to a direction in which the plurality of heat exchange fins extends.

17. An air conditioner including the outdoor device according to claim 16.

18. An outdoor device of an air conditioner, comprising:

a cabinet; and a base provided at a lower side of the cabinet, wherein the base includes:

a base body including at least one first seat by which a compressor is supported and at least one first drain hole to drain liquid; and an edge portion provided along a circumference of the base body to support a heat exchanger including a heat exchange tube and a plurality of heat exchange fins, wherein the edge portion includes:

an edge body provided at an upper side of the base body; and a plurality of second seats that protrudes in an upward direction from the edge body, wherein a guide that extends at an incline in a downward direction toward the at least one first drain hole is provided between the plurality of second seats.

19. An air conditioner including the outdoor device according to claim 18.

20. A base for an outdoor device for an air conditioner, the base comprising:

a base body configured to receive a compressor mounted thereon;

an edge portion provided along a circumference of the base body, the edge portion including at least one seat configured to support an heat exchanger; and a support guide provided on the edge portion to increase an area configured to support the heat exchanger, wherein the support guide includes at least one drain hole defined in the at least one seat that extends at an angle with respect to a direction in which the heat exchanger extends when mounted on the base.

21. An outdoor device including the base according to claim 20.

22. A base for an outdoor device for an air conditioner, the base comprising:

a base body including at least one first seat configured to support a compressor and at least one first drain hole to drain liquid; and an edge portion provided along a circumference of the base body and configured to support a heat exchanger including a heat exchange tube and a plurality of heat exchange fins, wherein the edge portion includes:

an edge body provided at an upper side of the base body;

at least one second seat that protrudes in an upward direction from the edge body; and at least one second drain hole defined in the second seat, wherein the at least one second drain hole is inclined at a predetermined angle with respect to a di ection which the plurality of heat exchange fins extends when the heat exchanger is mounted on the base.

23. An outdoor device including the base according to claim 22.

24. A base for an outdoor device for an air conditioner, the base comprising:

a base body on which at least one first seat configured to support a compressor is provided; and an edge portion provided along a circumference of the base body and configured to support a heat exchanger including a heat exchange tube and a plurality of heat exchange fins, wherein the edge portion includes:

an edge body provided at an upper side of the base body; and at least one second seat that protrudes in an upward direction from the edge body, wherein the at least one second seat includes an inclination portion which is inclined at a predetermined angle with respect to a direction in which the plurality of heat exchange fins extends when the heat exchanger is mounted on the base.

25. An outdoor device including the base according to claim 24.

26. A base for an outdoor device for an air conditioner, the base comprising:

a base body including at least one first seat configured to support a compressor and at least one first drain hole to drain liquid; and an edge portion provided along a circumference of the base body configured to support a heat exchanger including a heat exchange tube and a plurality of heat exchange fins, wherein the edge portion includes:

an edge body provided at an upper, side of the base body; and a plurality of second seats that protrudes in an upward direction from the edge body wherein aide that extends at an incline in a downward direction toward the at least one first drain hole is provided between the plurality of second seats.

27. An outdoor device including the base according to claim 26.

* * * * *